US007281610B2

(12) United States Patent
Ylinen et al.

(10) Patent No.: US 7,281,610 B2
(45) Date of Patent: Oct. 16, 2007

(54) ELEVATOR CONTROL BASED ON GROUP SIZE

(75) Inventors: Jari Ylinen, Hyvinkää (FI); Markku Kakko, Hyvinkää (FI)

(73) Assignee: Kone Corporation, Helsinki (FI)

( * ) Notice: Subject to any disclaimer, the term of this patent is extended or adjusted under 35 U.S.C. 154(b) by 0 days.

(21) Appl. No.: 11/484,710

(22) Filed: Jul. 12, 2006

(65) Prior Publication Data

US 2007/0017753 A1 Jan. 25, 2007

Related U.S. Application Data

(63) Continuation of application No. PCT/FI05/000048, filed on Jan. 25, 2005.

(30) Foreign Application Priority Data

Jan. 26, 2004 (FI) ..... 20040105

(51) Int. Cl.
*B66B 1/18* (2006.01)

(52) U.S. Cl. ..... 187/382; 187/388; 187/391; 187/396

(58) Field of Classification Search ..... 187/247, 187/248, 380–389, 391–396
See application file for complete search history.

(56) References Cited

U.S. PATENT DOCUMENTS

| | | | | |
|---|---|---|---|---|
| 5,345,049 | A * | 9/1994 | Bahjat et al. | 187/382 |
| 6,394,232 | B1 * | 5/2002 | Iwata et al. | 187/382 |
| 6,601,678 | B2 * | 8/2003 | Kostka et al. | 187/383 |
| 6,619,436 | B1 * | 9/2003 | Hikita | 187/382 |
| 6,793,044 | B2 * | 9/2004 | Koehler et al. | 187/382 |
| 7,014,015 | B2 * | 3/2006 | Nikovski et al. | 187/382 |
| 2001/0035314 | A1 | 11/2001 | Yoshida et al. | |

FOREIGN PATENT DOCUMENTS

EP 0 572 229 A1 12/1993

* cited by examiner

*Primary Examiner*—Jonathan Salata
(74) *Attorney, Agent, or Firm*—Birch, Stewart, Kolasch and Birch, LLP

(57) ABSTRACT

A method for allocating an elevator in a destination floor elevator system. An elevator group includes several elevators, a passenger data terminal for reserving elevators for use by passengers, and an elevator group control system for controlling the elevators in response to signals from the passenger data terminal. The method includes inputting the size and destination floor of the group of passengers into the control system of the elevator group, allocating one or more elevators to the group of passengers by utilizing the size and destination floor of the group, and informing the members of the group of passengers about the allocation.

32 Claims, 3 Drawing Sheets

ELEVATOR CONTROL BASED ON GROUP SIZE

This application is a Continuation of copending PCT International Application No. PCT/FI2005/000048 filed on Jan. 25, 2005, which designated the United States, and on which priority is claimed under 35 U.S.C. § 120. This application also claims priority under 35 U.S.C. § 119(a) on Patent Application No(s). 20040105 filed in Finland on Jan. 26, 2004. The entire contents of each of the above documents is hereby incorporated by reference.

FIELD OF THE INVENTION

Background of the Invention

The present invention relates to elevator systems. In particular, the present invention relates to a method for allocating an elevator in a destination floor elevator system which comprises: an elevator group comprising several elevators, a passenger data terminal for reserving elevators for use by passengers, and an elevator group control system for controlling the elevators that responds to signals from the said passenger data terminal.

DISCUSSION OF THE BACKGROUND

In destination floor elevator systems, each passenger wanting to enter an elevator gives at the building's landing level the destination floor to which he/she wants to travel. The destination floor is given by using a passenger data terminal specially reserved for this purpose, such a terminal being an extended version of a landing call button. The actual landing call button has been extended by adding a more versatile user interface allowing the user, i.e. the passenger, to indicate the floor that he/she wants to reach by elevator.

A destination floor elevator system like this and the passenger data terminal used in it for calling an elevator involve certain drawbacks. These drawbacks become apparent especially in an up-peak traffic situation, particularly in the mornings and at lunch time. These drawbacks include the following.

Especially during lunch hours, people using the buildings often go to lunch in groups with their own colleagues. However, in a prior-art destination floor elevator system, each passenger traveling on an elevator has to input his/her own destination floor to the destination floor elevator system independently. This naturally means that each passenger has to wait independently for his/her particular elevator allocated specially for him/her, although the passenger wants go to the same destination floor as another person belonging to the same group with him/her. A problem now arises as to how the users should behave in such a situation. Should each user stand in queue and await his/her own turn in order to give a call via the passenger data terminal and indicate his/her own destination floor to the destination floor elevator system. Further, even if the passenger should await his/her own turn in order to carry out these tasks via the passenger data terminal, he/she has to carry out these tasks and input his/her data. This takes time, on an average at least five seconds. On the other hand, if passengers do not await their own turn in order to input their destination floors to the destination floor elevator system and its passenger data terminal, then the elevator system will receive incomplete information as to the number of passengers actually traveling to a given destination floor.

In such a situation, the incomplete information received by the destination floor elevator system and especially its control system results in an impairment of the level of service provided by the elevator system to the passengers. It is obvious that if the elevator system had more accurate information regarding the number of passengers going to each destination floor, the elevators and the elevator system would be able to serve these passengers better. In prior-art solutions, the problem is that the elevators are filled prematurely and in an uncontrolled manner because not all members of a group traveling together let the system know that they are going to travel on the same elevator with the other members of the group.

Furthermore, even if the passengers should behave in a conventional destination floor elevator system like this in the manner described in the above-described ideal case, in other words, if each passenger awaited his/her own turn in order to use the passenger data terminal and gave accurate information regarding his/her own destination floor, there are still drawbacks apparent in this procedure. It is obvious that each passenger has to spend a specific amount of time, approximately five seconds, to input information concerning his/her destination floor and whether he/she belongs to a group. This means that the queues of people awaiting their turn at the passenger data terminal grow longer. An additional delay arises from the fact that the passenger can only indicate his/her destination floor when it is his/her turn to use the passenger data terminal and not immediately e.g. upon arrival in the building or when there appears a need for him/her to go to a given destination floor. Therefore, the information regarding the number of passengers and their destination floors reaches the destination floor elevator system and especially its control system later than would be necessary, and so the elevator allocation decisions have to be made on the basis of insufficient and belated information. As a consequence of this, the elevator allocation decisions are made with a delay and their quality is lower than in an ideal situation.

SUMMARY OF THE INVENTION

The object of the present invention is to implement a method and a system for allocating an elevator in a destination floor elevator system so that the above-mentioned problems encountered in prior-art solutions are avoided.

The method and system of the invention are characterized by what is disclosed in the characterization parts of claims 1 and 17. Other embodiments of the invention are characterized by what is disclosed in the other claims. Inventive embodiments are also presented in the description part of the present application. The inventive content disclosed in the application can also be defined in other ways than is done in the claims below. The inventive content may also consist of several separate inventions, especially if the invention is considered in the light of explicit or implicit sub-tasks or in respect of advantages or sets of advantages achieved. In this case, some of the attributes contained in the claims below may be superfluous from the point of view of separate inventive concepts. Within the framework of the basic concept of the invention, features of different embodiments of the invention can be applied in conjunction with other embodiments.

As for the features of the invention, reference is made to the claims.

The principal idea of the invention is to make it possible for a passenger using an elevator to indicate that he/she belongs to a group traveling at the same time from a landing level to one or more destination floors. Thus, according to the invention, when giving his/her destination floor, the passenger can also inform the system that he/she belongs to a group. This information is input using a passenger data terminal. In particular, the passenger data terminal may have a user interface with a menu or key for indicating that the passenger belongs to a group. It is also possible that only one of the members of the group inputs information to the passenger data terminal, telling the system how many members of the group are traveling to the destination floor. Thus, the destination floor elevator system and especially its elevator group control system receives information as to how many passengers are traveling from the landing level to the destination floor. The elevator system can now send an elevator that has a sufficient space for the whole group of passengers, or if necessary, the elevator system can send several elevators for the whole group.

The advantages of the present invention include the following:

The process of calling an elevator at a landing level or landing floor is accelerated in a situation where a group of passengers want to have a ride on the same elevator. In this case only one member of the group needs to define the size of the group and the desired destination floor.

Further, the system of the invention ensures that the passengers traveling in the same group can actually use the same elevator, so their group will remain coherent.

Further, the method of the invention shortens the queues formed at the passenger data terminal on the landing level, because it is not necessary for all the passengers comprised in the group to personally input a call for an elevator, but it suffices that one of the members of the group does so. Therefore, the queue in front of the passenger data terminal is substantially shortened. This means an increased degree of traveling comfort of passengers as there is less waiting and annoyance.

The solution disclosed also provides the advantage that the elevator allocation system receives the information regarding the number of passengers in the group and their destination floor at an earlier stage, so that a correct number of available elevators can be directed to the landing level more quickly than in prior-art solutions. At the same time, the information available regarding the numbers of passengers and their destination floors is more accurate, allowing the service level of the elevator system to be further improved. An additional advantage of the solution of the invention is that possible identification of an up-peak traffic condition can be performed earlier, because the identification of a peak traffic condition may occur in response to a large group size that a passenger has given while calling an elevator for a group by means of a passenger data terminal.

BRIEF DESCRIPTION OF THE DRAWINGS

A more complete appreciation of the invention and many of the attendant advantages thereof will be readily obtained as the same becomes better understood by reference to the following detail description when considered in connection with accompanying drawings, wherein.

DETAILED DESCRIPTION OF THE INVENTION

Figure 1:
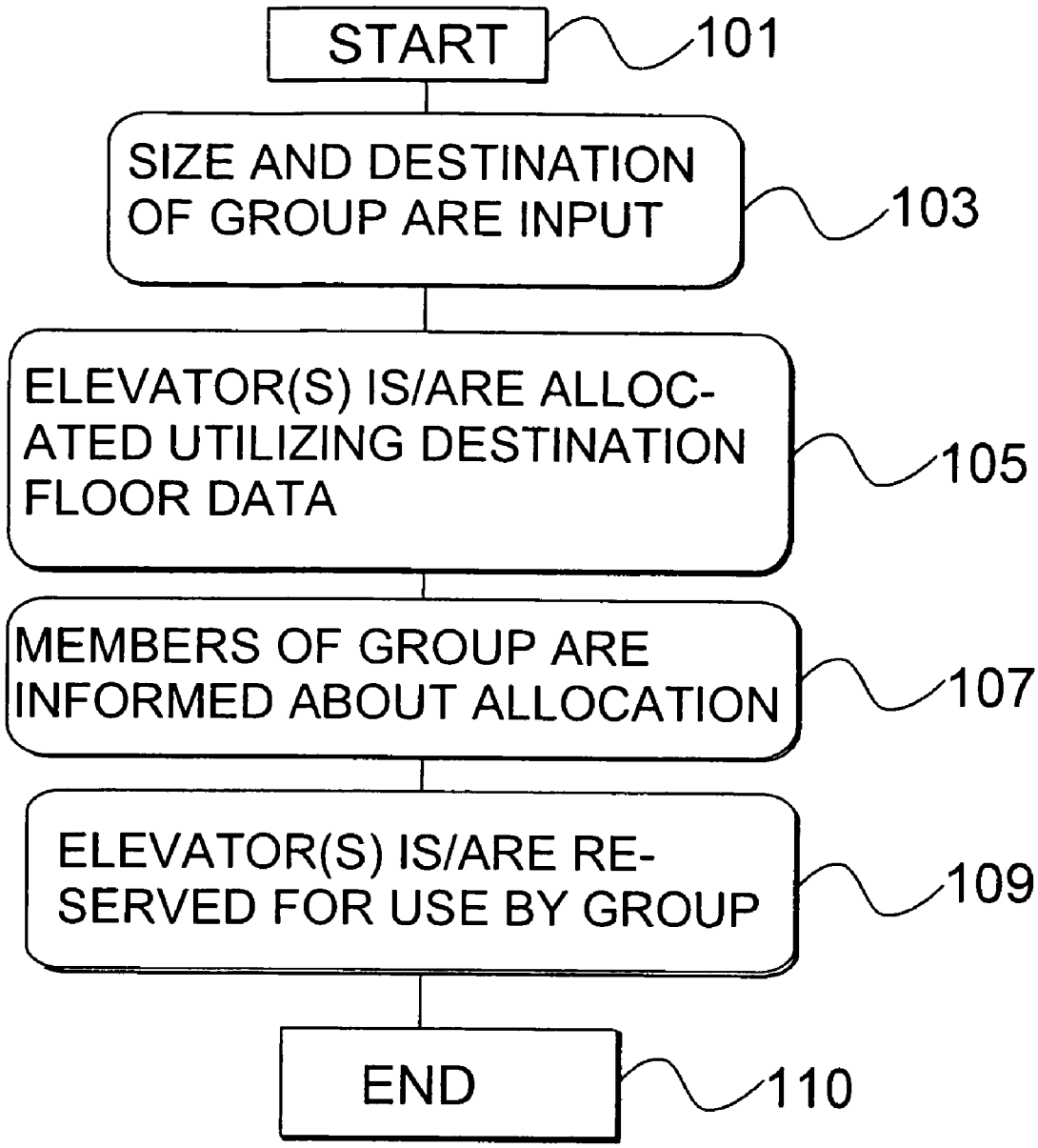
FIG. 1 presents a flow diagram illustrating the operation of the method of the invention.

Reference is now made to the drawings, wherein like reference numerals designate identical or corresponding part throughout the several views and more particularly to FIG. 1 which presents a flow diagram of the operation of the method of the invention. The method for allocating an elevator is implemented in a destination floor elevator system which comprises an elevator group consisting of several elevators, a passenger data terminal for reserving elevators for use by passengers and an elevator group control system for controlling the elevators, said control system responding to signals from said passenger data terminal. A feature typical of the destination floor elevator system is that a passenger data terminal is provided on the landing level of the building, i.e. on the floor where people arriving in the building enter to wait for elevator transport to their respective destination floors. Via the passenger data terminal, the passenger informs the system about his/her wish to travel to a given destination floor. Destination floor refers to that floor in the building that the passenger wants to reach.

Execution of the method of the invention starts from step 101. In the method of the invention, the size and destination floor of the group traveling together are input 103 to the control system of the elevator group. This is often done by the passenger, but it is also possible that another person, e.g. a member of the service personnel in the building does it. Having received information regarding the passenger's destination, the passenger data terminal sends this information to the elevator group control system. The elevator group control system allocates 105 a suitable elevator to the group of passengers. In the method of the invention, one or more elevators are allocated to the group of passengers, using the aforesaid group size and the aforesaid destination floor. That is to say, if the group can not be transported by one elevator, then several elevators are allocated to it. After this, the members of the group of passengers are informed 107 about the allocation. This information can be given via the aforesaid passenger data terminal. Another possibility is to communicate the information by using an illuminated indicator board. Such a board may be disposed in a space communicating with the landing level where passengers wait for the elevators. The information can also be communicated as an announcement given by a person or machine.

In the method of the invention, the allocation procedure, in which one or more elevators are allocated to a group of passengers, is carried out e.g. by optimizing elevator operation factors and/or the efficiency of passenger service. Operation factors and efficiency of passenger service refer e.g. to one or more of the following factors: utilization ratio of elevator, energy consumption of elevator, call time, waiting time and traveling time. It is also obvious that the allocation can also be implemented using e.g. a suitable mathematical algorithm.

An embodiment of the invention is characterized in that the allocation is implemented by placing the entire group of passengers in as small a number of elevators as possible. A second embodiment of the invention is characterized in that the group size is limited. It is also possible that the size of the group is not limited.

In the method of the invention, after the allocation one or more of the allocated elevators are reserved 109 for use by the group at the landing level. This means that the elevators are directed to the floor in question so that they can be used by the group waiting for them.

In an embodiment of the invention, identification of a peak traffic condition is performed in response to the group size which is input to the passenger data terminal by a passenger. This identification is used in the elevator group control system to change the control of the elevators in such manner that they are controlled in the way the elevators are controlled in a peak traffic condition. This may mean e.g. that elevators are sent to the landing level more frequently and quickly than calls for elevators are received from there. This ensures that the landing level will not be congested.

Figure 2:
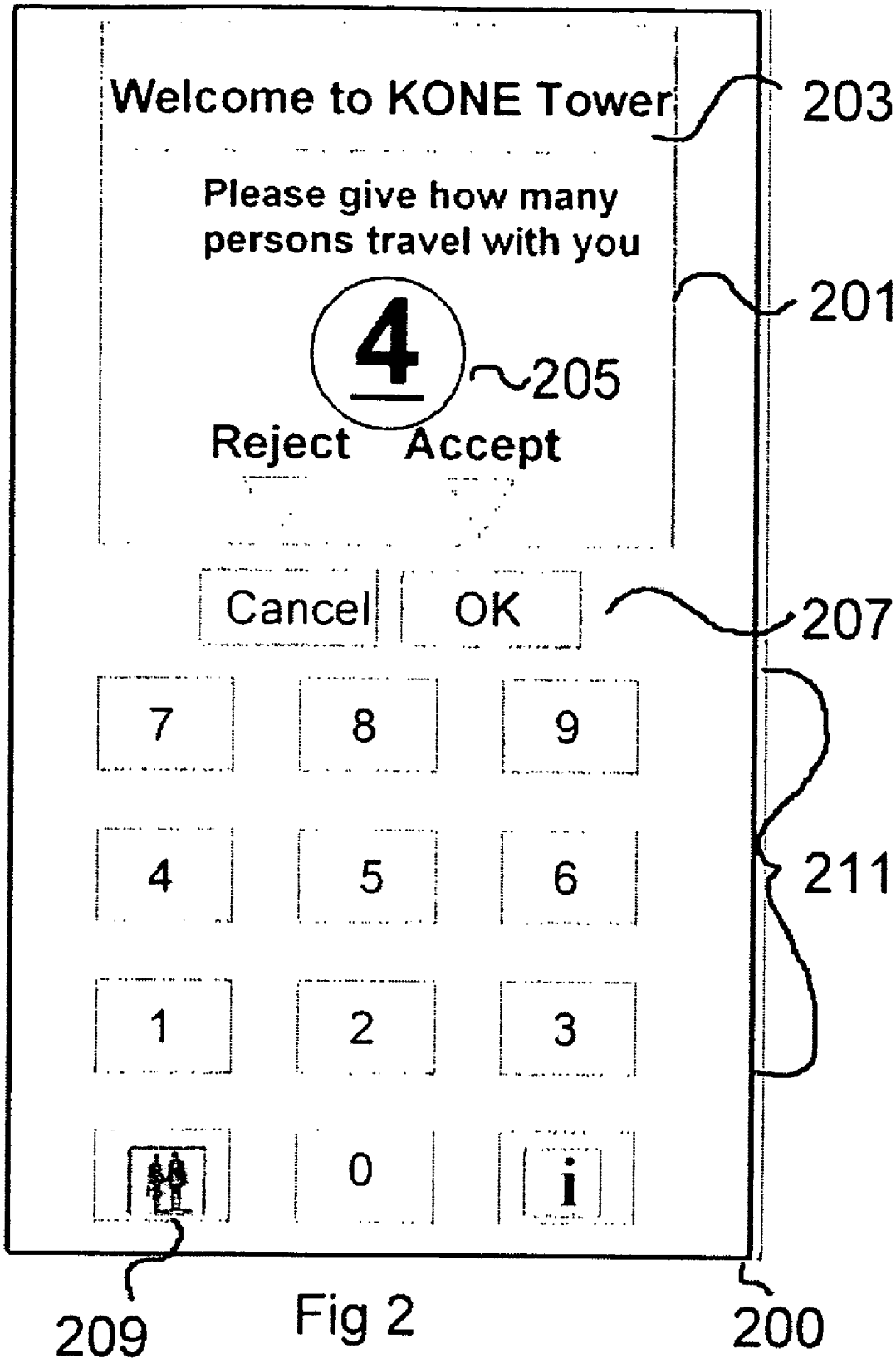
FIG. 2 presents a diagram of a passenger data terminal according to the invention.

FIG. 2 presents a diagram of the user interface 201 of a passenger data terminal 200 according to the invention. Such a passenger data terminal 200 is intended to be placed e.g. in the entrance hall of the building, at the landing level. The passenger data terminal 200 may be one of the following devices: a passenger data terminal in general use, a mobile station, a terminal in a data communication network, a terminal in a telecommunication network and/or a wireless terminal.

The group size and the destination floor are input via the passenger data terminal 200. This information is typically input by a passenger. It is also possible that the information is input by a person appointed to perform this task, e.g. the janitor of the building, a guard or other member of the service personnel.

In the method and system of the invention, the size and destination of the group of passengers are input in response to a prompt 203 given to the user. This prompt 203 can be given to the user via the passenger data terminal 200.

In the method and system, the size and destination of the group of passengers are input by using the user interface 201 of the passenger data terminal. This user interface 201 of the passenger data terminal comprises at least one of the following: group size indicator 205, push button 207, group key 209, window user interface 201 and/or keys 211 for defining the size of the group.

Figure 3:
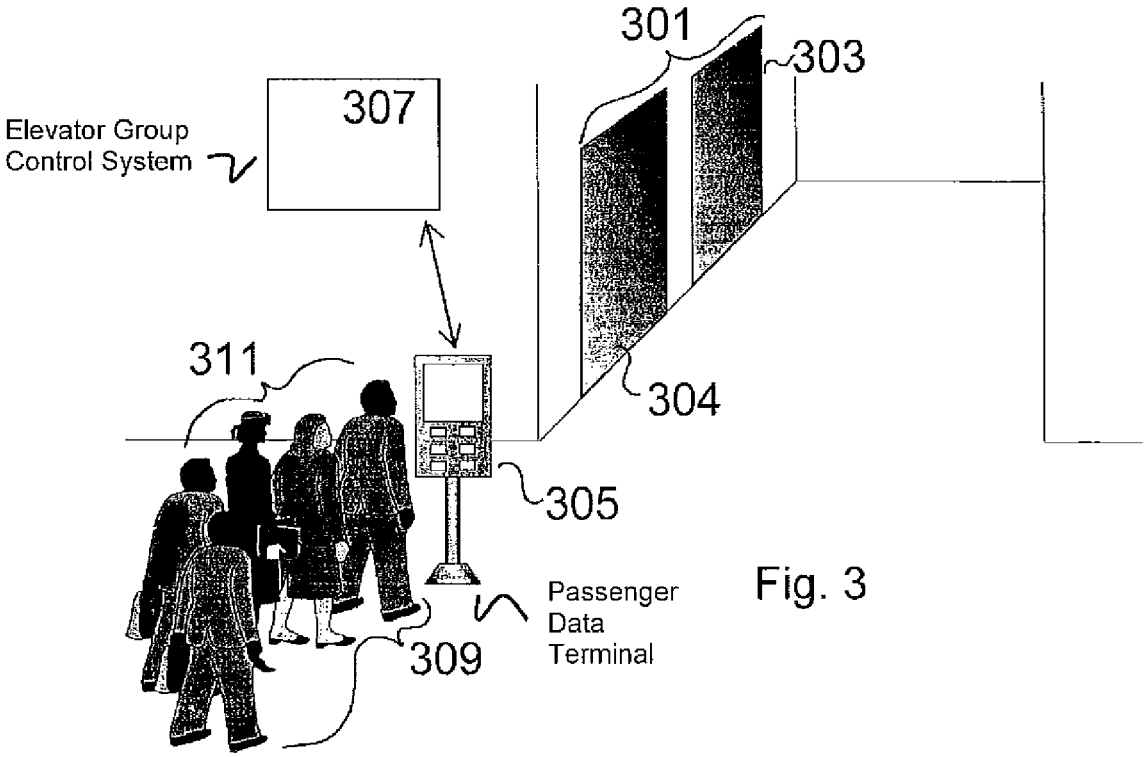
FIG. 3 presents an operation diagram of a destination floor elevator system according to the invention.

FIG. 3 presents an operation diagram of the destination floor elevator system according to the invention, which comprises: an elevator group 301 consisting of a number of elevators 303, 304, a passenger data terminal 305 for reserving elevators for use by the passengers. The system also comprises an elevator group control system 307 for controlling the elevators which responds to signals from the passenger data terminal 305. The elevator group control system 307 directs elevators to desired floors on the basis of the car calls received from the elevators and the landing calls received from different floors as well as the destination floor and group size data received from the passenger data terminal 305. In the control of the elevators, the elevator group control system 307 utilizes algorithms appropriate to the purpose.

In the destination floor elevator system of the invention, the passenger data terminal 305 has been arranged to receive the size and destination floor of the group of passengers and to send this information further to the elevator group control system 307. The elevator group control system 307 has been arranged to allocate one or more elevators to the group of passengers, using as basic data the size of the group and the destination floor that the members of the group wish to reach by elevator. The passenger data terminal 305 has been arranged to inform the members of the group of passengers regarding elevator allocation performed.

In this destination floor elevator system, especially on the landing level, the size and destination floor of the group are input via the passenger data terminal 305. The passenger data terminal may be one of the following devices: a passenger data terminal in general use, a mobile station, a terminal in a data communication network, a terminal in a telecommunication network and/or a wireless terminal. Thus, it is to be noted that, utilizing a telecommunication and data communication network, it is possible to provide in the user interface of the passenger's mobile terminal or computer an option to reserve an elevator for a desired trip for a desired group of passengers.

In the method and system of the invention, the input of the size and destination floor of the group of passengers takes place in response to a prompt given to the user. The prompt can be given via the user interface of the passenger data terminal. Further, the size and destination floor of the group of passengers can be input by using the user interface of the passenger data terminal.

The destination floor elevator system of the invention is characterized in that the aforesaid user interface of the passenger data terminal comprises at least one of the following items: group size indicator, push button, group key, window user interface and/or keys for defining the group size.

In the destination floor elevator system of the invention, the elevators are allocated e.g. by optimizing elevator operation factors and/or the efficiency of passenger service. Operation factors and efficiency of passenger service refer e.g. to one or more of the following factors: utilization ratio of elevator, energy consumption of elevator, call time, waiting time and traveling time. It is also obvious that the allocation can also be implemented using e.g. a suitable mathematical algorithm.

When passengers are to be placed in elevators in the destination floor elevator system of the invention, the allocation of elevators to different users or passengers is performed by placing the whole group of passengers in as small a number of elevators as possible. It is also possible that the size of a group traveling together is limited.

In practice, after the allocation of elevators in the destination floor elevator system of the invention, one or more of the allocated elevators is/are reserved for use by the group of passengers at the landing level. Passengers, especially groups of passengers, are informed about the allocation of elevators via the passenger data terminal. It is also possible to give this information by using an illuminated indicator board. It is likewise possible to communicate the information as a public announcement, which can be implemented e.g. by a speech synthesizer or the service personnel of the building.

In the destination floor elevator system of the invention, it is also possible that an up-peak traffic condition is identified in response to group size. This means that when a passenger calling an elevator gives the group size as a number exceeding a threshold value, this may be regarded as an indicator of the onset of an up-peak traffic condition. This identification of an up-peak traffic situation may also be conditional so that it is only implemented during certain periods, e.g. on weekdays in the morning between 07.30-09.20 and during lunch hours between 11.15-14.00.

It is obvious to the person skilled in the art that the invention is not limited to the embodiments described above, in which the invention was described by way of example, but that it may be varied within the scope of the inventive concept defined in the claims presented below.

The invention claimed is:

1. A method for allocating an elevator in a destination floor elevator system comprising:

an elevator group, which comprises several elevators, a passenger data terminal for reserving elevators for use by passengers, an elevator group control system for controlling the elevators which responds to signals from the said passenger data terminal, the method comprising:

inputting the size and destination floor of the group of passengers into the control system of the elevator group, allocating one or more elevators to the group of passengers on the basis of the said size and the said destination floor of the group, and informing the members of the said group of passengers about the allocation.

2. A method according to claim 1, wherein the size and destination floor of the group of passengers are input in response to a prompt given to the user.

3. A method according to claim 1, wherein the aforesaid allocation is performed by optimizing the operation factors of the elevators and/or the efficiency of passenger service.

4. A method according to claim 3, wherein the elevator operation factors and the efficiency of passenger service are determined on the basis of at least one of the following factors:

utilization ratio of the elevator;

energy consumption of the elevator;

call time;

waiting time; and traveling time.

5. A method according to claim 1, wherein the aforesaid allocation is implemented using a mathematical algorithm.

6. A method according to claim 1, wherein the aforesaid allocation is implemented by placing the entire group of passengers in as small a number of elevators as possible.

7. A method according to claim 1, wherein the said size of the group is limited.

8. A method according to claim 1, wherein after the aforesaid allocation, one or more of the allocated elevators are reserved for use by the said group at the landing level.

9. A method according to claim 1, wherein the aforesaid communication of information is performed using the said passenger data terminal.

10. A method according to claim 1, wherein the aforesaid communication of information is performed using an illuminated indicator board.

11. A method according to claim 1, wherein the aforesaid communication of information is performed using an announcement.

12. A method according to claim 1, wherein a peak traffic condition is identified in response to the said group size.

13. A method for allocating an elevator in a destination floor elevator system comprising:

an elevator group, which comprises several elevators, a passenger data terminal for reserving elevators for use by passengers, an elevator group control system for controlling the elevators which responds to signals from the said passenger data terminal, the method comprising:

inputting the size and destination floor of the group of passengers into the control system of the elevator group, by means of the said passenger data terminal, allocating one or more elevators to the group of passengers on the basis of the said size and the said destination floor of the group, and informing the members of the said group of passengers about the allocation.

14. A method according to claim 13, wherein the said passenger data terminal is one of the following devices:

a passenger data terminal in general use, a mobile station, a terminal in a data communication network, a terminal in a telecommunication network, and a wireless terminal.

15. A method according to claim 13, wherein the size and destination floor of the group of passengers are input by using the user interface of the passenger data terminal.

16. A method according to claim 15, wherein the said user interface of the passenger data terminal comprises at least one the following:

group size indicator, push button, group key, window user interface, and keys for defining group size.

17. A destination floor elevator system comprising:

an elevator group, which comprises several elevators, a passenger data terminal for reserving elevators for use by passengers, an elevator group control system for controlling the elevators which responds to signals from the said passenger data terminal, the said passenger data terminal being arranged to receive the size and destination floor of the group of passengers and to send them to the control system of the elevator group, the said control system of the elevator group being arranged to allocate one or more elevators to the group of passengers on the basis of the said size and destination floor of the group, and the said passenger data terminal being arranged to inform the members of the group of passengers about the aforesaid allocation.

18. A destination floor elevator system according to claim 17, wherein the size and destination floor of the group of passengers are input by means of the passenger data terminal.

19. A destination floor elevator system according to claim 18, wherein the said passenger data terminal is one of the following devices:

a passenger data terminal in general use, a mobile station, a terminal in a data communication network, a terminal in a telecommunication network, and a wireless terminal.

20. A destination floor elevator system according to claim 17, wherein the size and destination floor of the group of passengers are input in response to a prompt given to the user.

21. A destination floor elevator system according to claim 18, wherein the size and destination floor of the group of passengers are input by using the user interface of the passenger data terminal.

22. A destination floor elevator system according to claim 21, wherein the said user interface of the passenger data terminal comprises at least one the following:

group size indicator, push button, group key, window user interface, and keys for defining group size.

23. A destination floor elevator system according to claim 17, wherein the aforesaid allocation is performed by optimizing the operation factors of the elevators and/or the efficiency of passenger service.

24. A method according to claim 23, wherein the elevator operation factors and the efficiency of passenger service are determined on the basis of at least one of the following factors:

utilization ratio of the elevator;

energy consumption of the elevator;

call time;

waiting time; and travelling time.

25. A destination floor elevator system according to claim 17, wherein the aforesaid allocation is implemented using a mathematical algorithm.

26. A destination floor elevator system according to claim 17, wherein the aforesaid allocation is implemented by placing the entire group of passengers in as small a number of elevators as possible.

27. A destination floor elevator system according to claim 17, wherein the said size of the group is limited.

28. A destination floor elevator system according to claim 17, wherein after the aforesaid allocation, one or more of the allocated elevators are reserved at the landing level for use by the said group.

29. A destination floor elevator system according to claim 17, wherein the aforesaid communication of information is performed using the said passenger data terminal.

30. A destination floor elevator system according to claim 17, wherein the aforesaid communication of information is performed using an illuminated indicator board.

31. A destination floor elevator system according to claim 17, wherein the aforesaid communication of information is performed using an announcement.

32. A destination floor elevator system according to claim 17, wherein a peak traffic condition is identified in response to the said group size.

* * * * *